US005514224A

United States Patent [19]

Panchanathan

[11] Patent Number: 5,514,224

[45] Date of Patent: May 7, 1996

[54] HIGH REMANENCE HOT PRESSED MAGNETS

[75] Inventor: Viswanathan Panchanathan, Anderson, Ind.

[73] Assignee: Magnequench International, Inc., Anderson, Ind.

[21] Appl. No.: 148,155

[22] Filed: Nov. 5, 1993

[51] Int. Cl.[6] ..... H01F 1/057

[52] U.S. Cl. ..... 148/104; 148/101; 419/12

[58] Field of Search ..... 148/101, 104; 419/12

[56] References Cited

U.S. PATENT DOCUMENTS

| | | | |
|---|---|---|---|
| 4,792,367 | 12/1988 | Lee | 148/104 |
| 4,801,340 | 1/1989 | Inoue et al. | 148/104 |
| 4,935,074 | 6/1990 | DeMooij et al. | 148/302 |
| 5,093,076 | 3/1992 | Young et al. | 419/12 |
| 5,100,485 | 3/1992 | Yamashita et al. | 148/101 |
| 5,167,915 | 12/1992 | Yamashita et al. | 419/12 |
| 5,178,692 | 1/1993 | Panchanathan | 148/101 |

OTHER PUBLICATIONS

Takahashi et al, "The Magnetic Properties of Nd–Fe–B Melt–Spun Ribbons with Lower Nd Content", *Transactions of the Institute of Electrical Engineers of Japan,* vol. 113–A, No. 4, 1993, pp. 251–260.

Li et al, "Magnetic Properties and Phase Compositions of Rapidly Quenched $Nd_4Fe_{96-x}B_x$ After Crystallization", *Hyperfine Interactions,* vol. 72 (1992), pp. 111–121.

*Patent Abstract of Japan,* vol. 12, No. 228 (E–627)(3075), Jun. 28, 1988—Abstract of JP 63–21804A.

*Patent Abstracts of Japan,* vol. 18, No. 351 (C–1220), Jul. 4, 1994—Abstract of JP 6099159.

Hirosawa et al., "High–coercivity . . . rare–earth permanent magnet material based on $(Fe,Co)_3B$–Nd–M (M=Al,Si,Cu, Ga,Ag,Au)"; J. Appl. Phys. 73(10), 15 May 1993.

*Primary Examiner*—John Sheehan
*Attorney, Agent, or Firm*—Pennie & Edmonds

[57] ABSTRACT

Isotropic hot pressed iron-rare earth metal permanent magnets are provided wherein the hot pressed permanent magnet exhibits magnetic remanences of at least about 9 kG, and most typically about 10 kG. Preferred compositions include a relatively low rare earth content coupled with an optimal amount of boron. The preferred composition is, on a weight percent basis, from about 5 to about 25 percent rare earth, most preferably about 10 to about 20 percent rare earth, from about 0.5 to about 4.5 percent boron, most preferably from about 0.8 to about 4.0 percent boron, wherein the total combination of the rare earths and boron ranges from about 9 percent to about 26 percent, most preferably from about 12 percent to about 22 percent, and optionally from about 2 percent to about 16 percent cobalt, with the balance being essentially iron.

4 Claims, 3 Drawing Sheets

HIGH REMANENCE HOT PRESSED MAGNETS

The present invention generally relates to the making of high remanence hot pressed permanent magnets based primarily on iron, rare earths such as neodymium and/or praseodymium and/or dysprosium, and boron, wherein the total amount of the rare earth constituent is relatively low but coupled with an optimal amount of boron. More specifically, this invention relates to the forming of such magnets having magnetic remanences of greater than about 9 kiloGauss (kG), and most typically about 10 kG, by hot pressing permanent magnet particles having, in weight percents, a rare earth level of from about 5 percent to 25 percent, most preferably from about 10 percent to about 20 percent, and preferably combined with a boron content of from about 0.5 percent to about 4.5 percent, most preferably from about 0.8 percent to about 4.0 percent, wherein the total amount of the rare earth constituent and boron ranges from about 9 percent to about 26 percent, most preferably from about 12 percent to about 22 percent.

BACKGROUND OF THE INVENTION

Permanent magnets based on compositions containing iron, neodymium and/or praseodymium, and boron are known and in commercial usage. Such permanent magnets contain as an essential magnetic phase grains of tetragonal crystals in which the proportions of, for example, iron, neodymium and boron are exemplified by the empirical formula $Nd_2Fe_{14}B$. These magnet compositions and methods for making them are described by Croat in U.S. Pat. No. 4,802,931 issued Feb. 7, 1989. The grains of the magnetic phase are surrounded by a second phase that is typically rare earth-rich, as an example neodymium-rich, as compared with the essential magnetic phase. It is known that magnets based on such compositions may be prepared by rapidly solidifying, such as by melt spinning, a melt of the composition to produce fine grained, magnetically isotropic platelets of ribbon-like fragments. Magnets may be formed from these isotropic particles by practices which are known, such as bonding the particles together with a suitable resin.

Although the magnets formed from these isotropic ribbons are satisfactory for some applications, they typically exhibit an energy product (BHmax) of about 8 to about 10 megaGaussOersteds (MGOe), which is insufficient for many other applications. To improve the energy product, it is known to hot press the isotropic particles to form magnets having an energy product of about 13 to about 14 MGOe and magnetic remanences on the order of about 8 kG.

However, there are applications when it would be desirable that such hot pressed magnets have higher magnetic remanence values. As an example, if the hot pressed magnet is used in an application at or near its maximum magnetic remanence, it may be desirable to increase its magnetic remanence so as to increase the capability of the magnet.

Conventionally, for hot pressed magnets of the iron-rare earth metal type, the total rare earth constituent is greater than about 25 percent, most typically greater than about 29 percent, by weight. This is true since compositions containing lower amounts of the rare earth constituents contain lesser amounts of the intergranular phase, and therefore require higher pressing temperatures, which are detrimental to the life of the hot pressing punches and add undesirable costs to the pressing process. Thus, the prior art has generally always taught that hot pressed permanent magnet compositions of this type must contain, as a minimum, at least 25 percent rare earth constituent.

Yet, it would be desirable to provide a means for increasing the magnetic remanence of a hot pressed magnet, such as to a value of at least about 9 kG or 10 kG, while simultaneously reducing or minimizing the amount of rare earth within the compositions, since the rare earth constituents are typically much more costly as compared to the other constituents. However, the means for accomplishing such an increase in magnetic remanence should not result in increased hot pressing temperatures.

SUMMARY OF THE INVENTION

It is therefore an object of this invention to provide an isotropic hot pressed permanent magnet exhibiting a magnetic remanence of at least about 9 kG, preferably about 10 kG.

It is a further object of this invention that such an isotropic hot pressed magnet have a composition that has, as its magnetic constituent, the tetragonal crystal phase $RE_2TM_{14}B$ which is based primarily on neodymium and/or praseodymium, iron and boron, and wherein the total amount, in weight percent, of rare earth constituent ranges from about 5 percent to about 25 percent, preferably from about 10 percent to about 20 percent, and is coupled with a boron content of from about 0.5 percent to about 4.5 percent, preferably from about 0.8 percent to about 4.0 percent, such that the combined amount of rare earth and boron within the composition ranges from about 9 percent to about 26 percent, most preferably from about 12 percent to about 22 percent.

Furthermore, it is an object of this invention that such a hot pressed magnet having a magnetic remanence of at least about 9 to 10 kG be pressed at conventional pressing temperatures.

In accordance with a preferred embodiment of this invention, these and other objects and advantages are accomplished as follows.

According to the present invention, there is provided an isotropic hot pressed iron-rare earth metal permanent magnet, wherein the hot pressed permanent magnet exhibits magnetic remanences of at least about 9 kG, and most typically about 10 kG, which is nearly 62% of saturation magnetization for this material. This is believed to be the highest value reported for an isotropic magnet of this type. The hot pressed magnet of this invention is produced by pressing a quantity of isotropic iron-rare earth metal particles. The isotropic particles can be formed by known methods, such as by melt spinning a suitable iron-rare earth metal composition to an overquenched or optimum condition. Isotropic particles formed by melt spinning are generally ribbon-shaped and can be readily reduced to particle size.

The preferred composition is, on a weight percent basis, from about 5 percent to about 25 percent rare earth, most preferably about 10 percent to about 20 percent rare earth, from about 0.5 percent to about 4.5 percent boron, most preferably from about 0.8 percent to about 4.0 percent boron, with the total combination of rare earth plus boron ranging from about 9 percent to about 26 percent, most preferably from about 12 percent to about 22 percent, and optionally from about 2 percent to about 16 percent cobalt, with the balance being essentially iron.

Other metals may also be present in minor amounts of up to about two weight percent, either alone or in combination.

These metals include tungsten, chromium, nickel, aluminum, copper, magnesium, manganese, gallium, niobium, vanadium, molybdenum, titanium, tantalum, zirconium, carbon, tin and calcium. Silicon is also typically present in small amounts, as are oxygen and nitrogen.

The isotropic particles are then hot pressed at conventional temperatures, which is contrary to prior art teachings wherein the relatively low level of rare earth constituents within the magnet compositions of this invention would require increased hot pressing temperatures to result in useful magnetic remanences. A particular advantage of this invention is that conventional hot pressing temperatures may be used, even though relatively low levels of the rare earth constituents are present. It is believed that this is due to the presence of an optimal level of boron coupled with the rare earths, which enables the use of conventional hot pressing temperatures. The hot pressed iron-rare earth metal permanent magnets of this invention exhibit an improved magnetic remanence of at least about 9 to 10 kG, in contrast to conventional hot pressed magnets of the prior art containing rare earth levels in excess of about 25 weight percent having a magnetic remanence of about 8 kG.

Accordingly, with the teachings of this invention, magnetic remanences of at least about 9 kG, and preferably on the order of about 10 kG, may be easily achieved in a hot pressed magnet, wherein the composition of the magnet includes a relatively low rare earth content coupled with an optimal boron content. Yet the increase in magnetic remanence is achieved in the preferred hot pressed compositions having the relatively low rare earth content, without the previous requirement for elevated hot pressing temperatures.

In addition, since the rare earth constituent is typically the most expensive component of these types of magnet compositions, a reduction in the amount of rare earth present in the magnet composition corresponds to a reduction in its overall price, which is an additional benefit of the preferred compositions of this invention.

Other objects and advantages of this invention will be better appreciated from the following detailed description.

BRIEF DESCRIPTION OF THE DRAWINGS

Reference will be made to the accompanying drawings wherein.

DETAILED DESCRIPTION OF THE INVENTION

Figure 1:
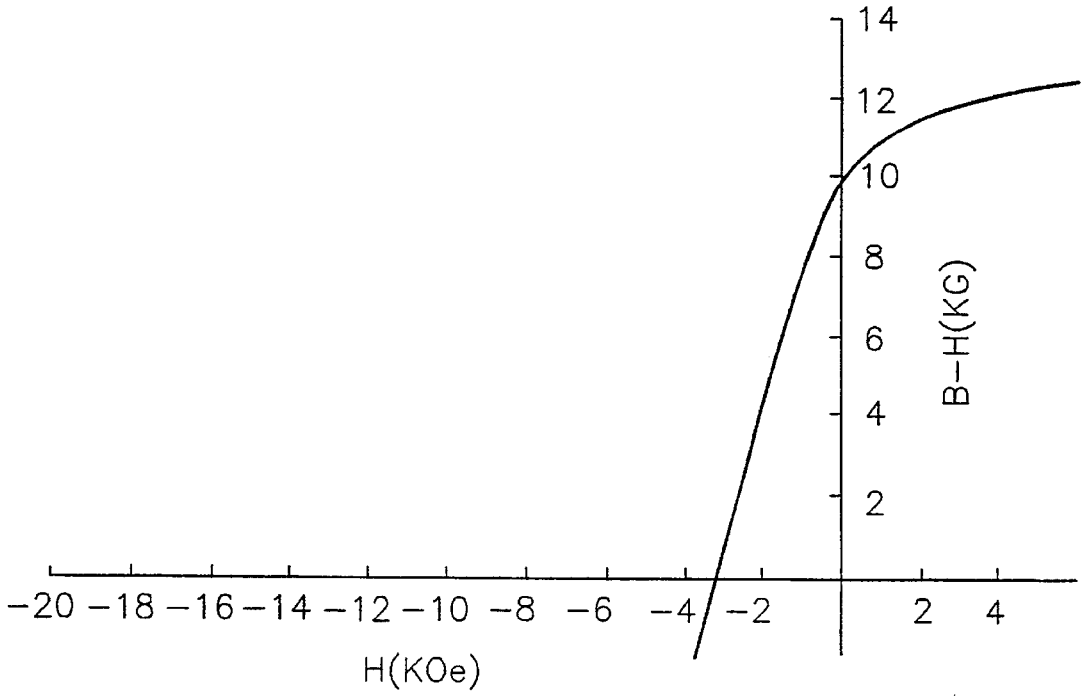
FIGS. 1 through 5 illustrate demagnetization curves for hot pressed magnets formed from magnetically isotropic particles of the preferred iron-rare earth-boron composition of this invention.

The preferred compositions of this invention result in isotropic hot pressed, fully dense permanent magnets which exhibit magnetic remanences of at least about 9 kG, more typically about 10 kG. The preferred compositions are characterized by a relatively low total rare earth content coupled with boron. Advantageously, the hot pressed magnets may be formed at conventional pressing temperatures.

Appropriate compositions for the iron-rare earth metal permanent magnet of this invention include a suitable transition metal component, a suitable rare earth component and boron, as well as possible small additions of cobalt, and are generally represented by the empirical formula $RE_2TM_{14}B$. The preferred compositions, as stated previously, consist of, on an atomic percentage basis, about 40 to 90 percent of iron or mixtures of cobalt and iron, with the iron preferably making up at least 60 percent of the non-rare earth metal content; about 3 to about 12 percent of rare earth metal that necessarily includes neodymium and/or praseodymium, with the neodymium and/or praseodymium preferably making up at least about 60 percent of the rare earth content; and the rare earth being coupled with about 4 to about 20 percent boron. Preferably, iron makes up at least about 40 atomic percent of the total composition.

Specific compositions which have been useful in preparing hot pressed, fully dense, isotropic permanent magnets of this type, in corresponding weight percentages, are as follows and contain the hard magnetic phase consisting of $Fe_{14}Nd_2B$ (or the equivalent) tetragonal crystals; from about 5 percent to about 25 percent rare earth, most preferably about 10 percent to about 20 percent rare earth, wherein the majority constituent is neodymium and the remainder is praseodymium and/or dysprosium; from about 0.5 percent to about 4.5 percent boron, most preferably from about 0.8 percent to about 4.0 percent boron, wherein the combined amount of the rare earths and boron ranges from about 9 percent to about 26 percent, most preferably from about 12 percent to about 22 percent, and optionally from about 2 percent to about 16 percent cobalt, with the balance being essentially iron.

As stated previously, other metals may also be present in minor amounts of up to about two weight percent, either alone or in combination. These metals include tungsten, chromium, nickel, aluminum, copper, magnesium, manganese, gallium, niobium, vanadium, molybdenum, titanium, tantalum, zirconium, carbon, tin and calcium. Silicon is also typically present in small amounts, as are oxygen and nitrogen.

However, it is to be understood that the teachings of this invention are applicable to the larger family of compositions as described previously in atomic percentages and will be referred to generally as an iron-rare earth-boron composition.

Generally, permanent magnetic bodies of the preferred composition are formed by starting with alloy ingots which are melted by induction heating under a dry, substantially oxygen-free argon, inert or vacuum atmosphere to form a uniform molten composition. Preferably, the molten composition is then rapidly solidified to produce an amorphous material or a finely crystalline material in which the grain size is less than about 400 nanometers at its largest dimension. It is most preferred that the rapidly solidified material have a grain size smaller than about 20 nanometers. Such material may be produced, for example, by conventional melt spinning operations. Conventionally, the substantially amorphous or microcrystalline, melt-spun iron-neodymium-boron ribbons are then milled to a powder, though the ribbons can be used directly with this invention.

The iron-neodymium-boron particles, which are magnetically isotropic at this point, are then hot pressed at a sufficient pressure and duration to form a fully dense material. Typically, this is achieved by heating the composition to a suitable temperature, such as about 750° C., or preferably between about 750° C. to about 800° C., in a die, and compacting the composition between upper and lower punches, under a pressure of, for example, about 5 to about 6 tons per square inch, so as to form a substantially fully dense, flat cylindrical plug. Generally, when melt-spun material finer than about 20 nanometers in grain size is heated at such an elevated temperature for a period of a minute or so and hot pressed to full density, the resultant body is a permanent magnet. If the particulate material has been held at the hot pressing temperature for a suitable period of time, it will then have a grain size in the range of about 20 to about 500 nanometers, preferably about 20 to 100 nanometers.

The magnetic properties of hot pressed isotropic permanent magnets formed in accordance with this invention were determined using conventional Hysteresis Graph Magnetometer (HGM) tests. Test samples were placed such that the axis parallel to the direction of alignment was parallel to the direction of the field applied by the HGM. The samples were each then magnetized to saturation and then demagnetized.

The second quadrant demagnetization plots are shown in FIGS. 1 through 5 [4πM in kiloGauss versus coercivity (H) in kiloOersteds] for the preferred isotropic hot pressed permanent magnets of this invention.

The specific samples tested are described more fully below. For the specific examples below, melt spinning at a rate of 22 meters/second was followed by crushing of the magnetically isotropic melt-spun material to form the particulate material which was then shaped into a preform. The preform was then hot pressed at a temperature of about 750° C., and under a pressure of about 5 to about 6 tons per square inch, to form the fully dense hot pressed magnets, which are essentially the same conditions used to form conventional hot pressed permanent magnet bodies having high rare earth contents. It is to be noted that the bounds of this invention are not to be limited by the particular melt spinning rate and hot pressing temperatures used for these illustrative examples.

EXAMPLE 1

A fully dense, hot pressed isotropic permanent magnet was formed as described above and tested. The nominal composition, in weight percent, was about 12.7 percent total rare earth (at least about 95 percent of this constituent being neodymium and the remainder being essentially praseodymium), about 3.9 percent boron, about 3.5 percent cobalt, about 1.2 percent gallium, and the balance iron. The magnet had a diameter of about 16 millimeters, a height of about 11 millimeters and a weight of about 10 grams.

The second quadrant demagnetization plot for this magnet is shown in FIG. 1 and indicates a magnetic remanence ($B_r$) of about 10.0 kG and an intrinsic coercivity ($H_{ci}$) of about 3.4 kiloOersteds (kOe). It was determined that the saturation magnetization value for this low rare earth composition was about 16 kG; therefore, the magnetic remanence of 10 kG obtained after hot pressing was greater than 62 percent of the saturation value. It is believed that this value is the highest reported for an isotropic magnet of this type. The properties of the magnet were tested in all three directions and the magnet was determined to be isotropic.

EXAMPLE 2

A fully dense, hot pressed isotropic permanent magnet was formed as described above and had a nominal composition, in weight percent, of about 13.9 percent total rare earth (at least about 95 percent of this constituent being neodymium and the remainder being essentially praseodymium), about 4 percent boron, and the balance iron.

Figure 2:
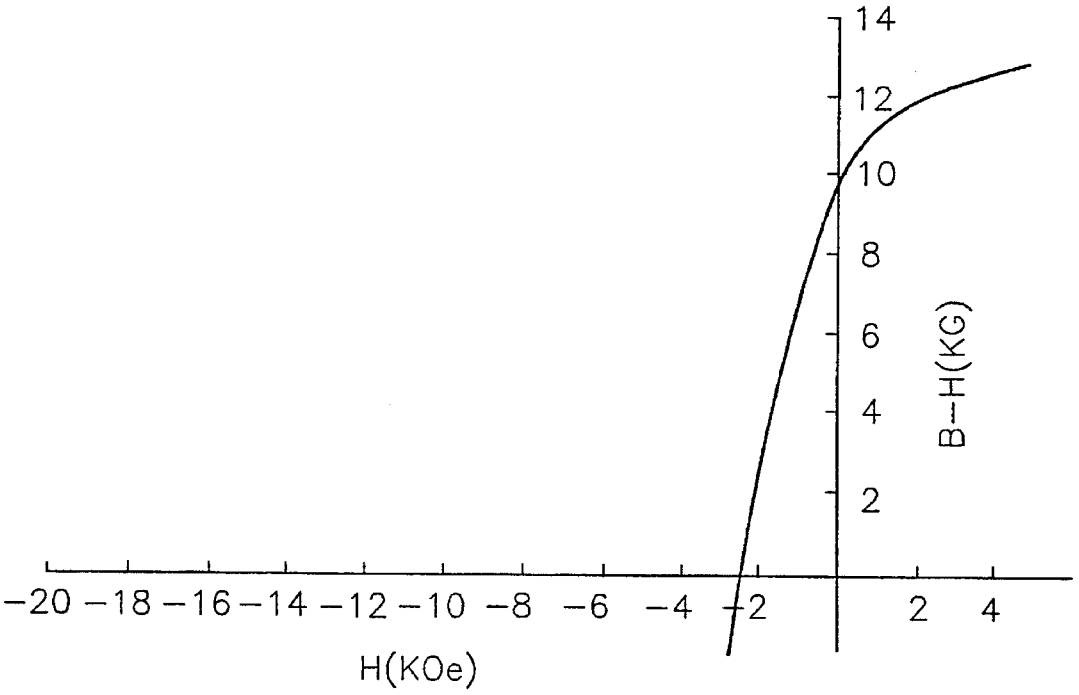

The second quadrant demagnetization plot for this magnet is shown in FIG. 2 and indicates a magnetic remanence ($B_r$) of about 9.6 kG and an intrinsic coercivity ($H_{ci}$) of about 2.4 kOe.

EXAMPLE 3

A fully dense, hot pressed isotropic permanent magnet was formed as described above and had a nominal composition, in weight percent, of about 2.6 percent dysprosium with the total rare earth constituent being 11.2 percent, about 3.8 percent boron, about 3.5 percent cobalt, about 1.3 percent gallium, and the balance iron.

Figure 3:
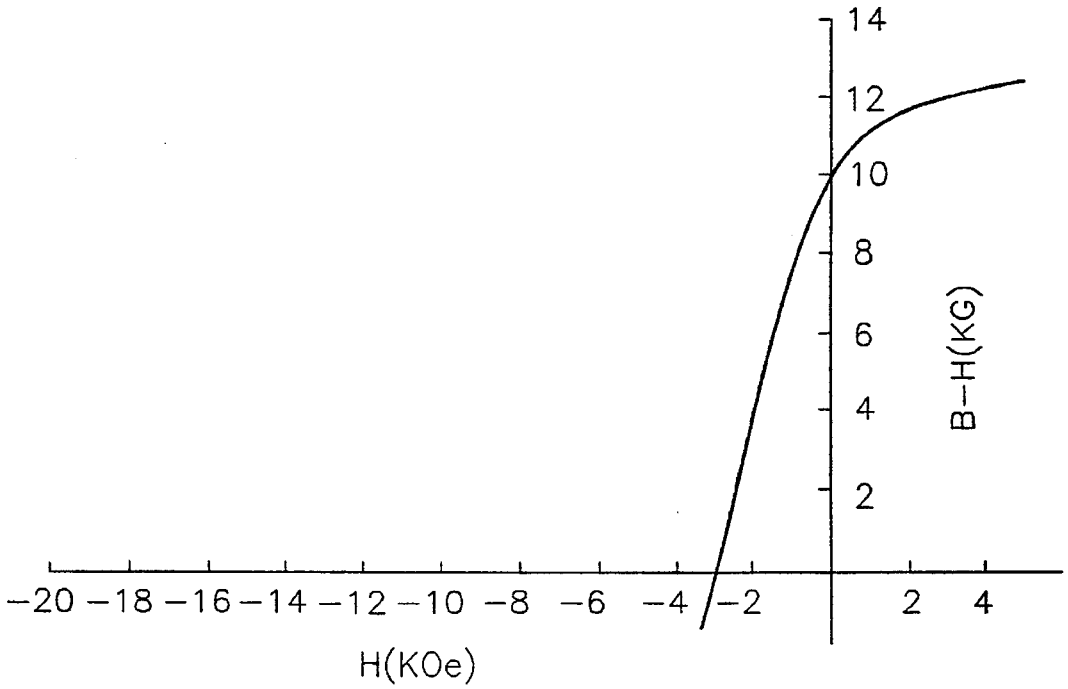

The second quadrant demagnetization plot for this magnet is shown in FIG. 3 and indicates a magnetic remanence ($B_r$) of about 10 kG and an intrinsic coercivity ($H_{ci}$) of about 2.8 kOe.

EXAMPLE 4

A fully dense, hot pressed isotropic permanent magnet was formed as described above and tested. The nominal composition, in weight percent, was about 12.6 percent total rare earth (at least about 95 percent of this constituent being neodymium and the remainder being essentially praseodymium), about 3.8 percent boron, and the balance iron.

Figure 4:
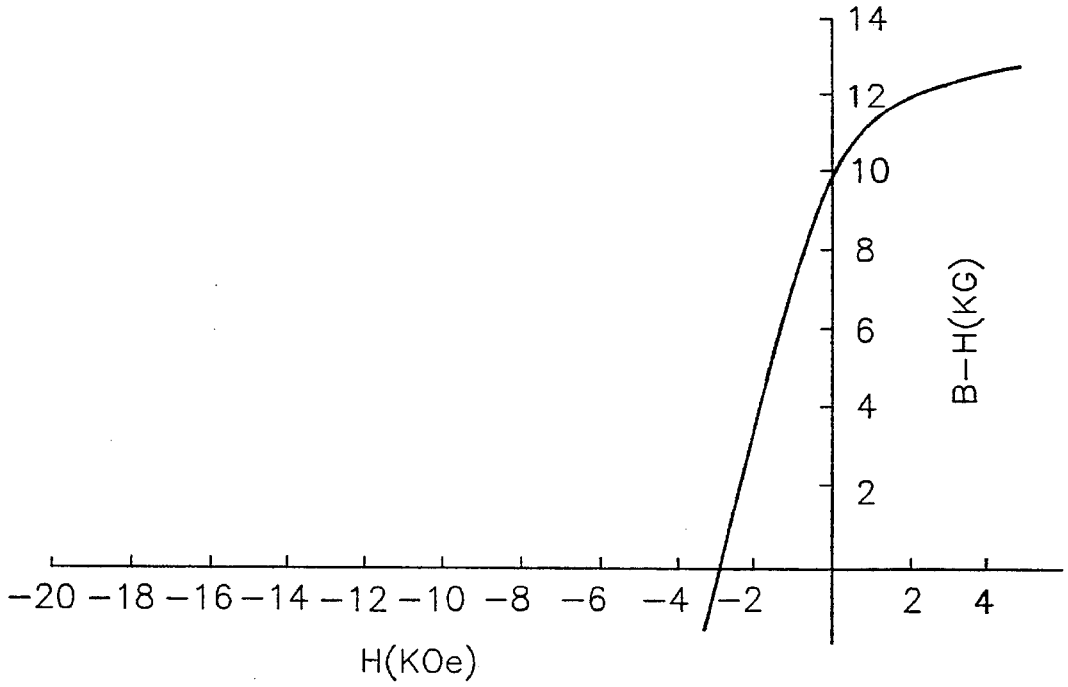

The second quadrant demagnetization plot for this magnet is shown in FIG. 4 and indicates a magnetic remanence ($B_r$) of about 9.9 kG and an intrinsic coercivity ($H_{ci}$) of about 2.8 kOe.

EXAMPLE 5

A fully dense, hot pressed isotropic permanent magnet was formed as described above having a nominal composition, in weight percent, of about 19 percent total rare earth (at least about 95 percent of this constituent being neodymium and the remainder being essentially praseodymium), about 1 percent boron, and the balance iron.

Figure 5:
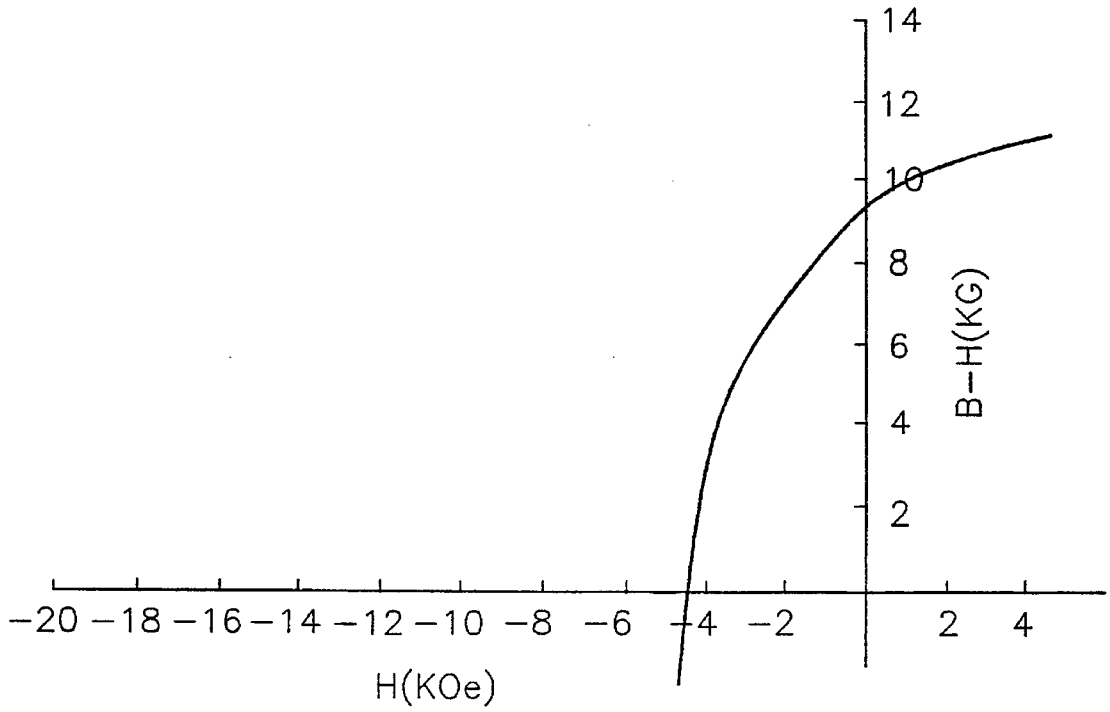

The second quadrant demagnetization plot for this magnet is shown in FIG. 5 and indicates a magnetic remanence ($B_r$) of about 9.6 kG and an intrinsic coercivity ($H_{ci}$) of about 4.3 kOe.

From the above, it can be seen that hot pressed isotropic permanent magnets having improved magnetic remanences of at least about 9.0 kG, more typically about 10.0 kG, can be formed using compositions containing relatively low levels of rare earths coupled with a sufficient amount of boron. It was determined that by reducing the amount of neodymium in the preferred Nd—Fe—B alloys, the $Fe_3B$ phase also becomes an equilibrium phase with the $Nd_2Fe_{14}B$ phase. In addition, the α-Fe phase is also present. It is further believed that the magnetic remanence of these preferred alloys are dominated by the soft magnetic $Fe_3B$ phase, while coercivity is controlled by the dispersion of the hard magnetic $Nd_2Fe_{14}B$ phase. Therefore, further improvements in magnetic properties are possible through modifications of intrinsic properties of the individual phases through specific alloying in accordance with the teachings of this invention.

A particular advantage of this invention is that conventional hot pressing temperatures may be used, even though relatively low levels of the rare earth constituents are present, as opposed to the teachings of the prior art. It is believed that this is due to the presence of optimal levels of boron coupled with the rare earths. The hot pressed iron-rare earth metal permanent magnets of this invention exhibit an improved magnetic remanence of at least about 9 to 10 kG, as compared to conventional hot pressed magnets of the prior art having magnetic remanences of about 8 kG and containing rare earth levels in excess of about 25 weight percent.

In addition, a significant cost savings can be achieved without a discernible loss in magnetic properties with the compositions of this invention since the amount of rare earth constituents, which are the most expensive constituents of these types of permanent magnets, is significantly reduced.

Accordingly, with the teachings of this invention, magnetic remanences of at least about 9 kG, and preferably on the order of about 10 kG, which are believed to be the highest values reported for an isotropic magnet of this type, may be readily achieved in a hot pressed magnet, wherein the composition of the magnet includes a relatively low rare earth content coupled with an optimal level of boron.

Therefore, while this invention has been described in terms of a preferred embodiment, it is apparent that other forms could be adopted by one skilled in the art. For example, the composition of the magnetic particles could be varied within the preferred weight and atomic ranges, with or without other constituents as described above, or different and/or additional processing steps may be employed to produce the isotropic particles used to form the hot pressed isotropic magnets, as well as other variations. Accordingly, the scope of this invention is to be limited only by the following claims.

The embodiments of the invention in which an exclusive property or privilege is claimed are defined as follows:

1. A method for forming a hot pressed iron-rare earth-boron permanent magnet, the method comprising the step of;

providing a quality of isotropic iron-rare earth-boron metal particles having a grain size of not more than about 500 nanometers, wherein said quality of isotropic iron-rare earth-boron metal particles are formed from a composition comprising, on a weight percent basis, from about 10 to about 20 percent rare earth metal, from about 0.8 to about 4.0 percent boron, and wherein the total of said rare earth metal and said boron ranges from about 12 to about 22 percent, with the balance being principally iron; and hot pressing said quality of isotropic iron-rare earth-boron metal particles at a temperature of about 750° C. to about 800° C. and for a duration sufficient to form a hot pressed isotropic iron-rare earth-boron metal permanent magnet characterized by the uniform presence of both the hard magnetic phase $Nd_2Fe_{14}B$ and the soft magnetic phases $Fe_3B$ and $\alpha$-Fe, and a magnetic remanence of at least about 9 kiloGauss.

2. A method for forming a hot pressed iron-rare earth-boron permanent magnet as recited in claim 1 wherein the majority of said rare earth metal is neodymium.

3. A method for forming a hot pressed iron-rare earth-boron permanent magnet as recited in claim 1 further comprising from about 2 to about 16 percent cobalt.

4. A method for forming a hot pressed iron-rare earth-boron permanent magnet as recited in claim 1 wherein said rare earth ranges from about 11.2 to about 19 percent rare earth metal, and said boron ranges from about 1 to about 3.9 percent boron, and wherein said total of said rare earth metal and said boron ranges from about 15 to about 20 percent.

* * * * *